US006807706B2

(12) United States Patent
Fernandez-Grandizo Martinez

(10) Patent No.: US 6,807,706 B2
(45) Date of Patent: Oct. 26, 2004

(54) VACUUM CLEANER LOCKING SYSTEM

(75) Inventor: Jesus Fernandez-Grandizo Martinez, Mexico City (MX)

(73) Assignee: Koblenz Electrica, S.A. de C.V., Cauautitlan Izcalli (MX)

( * ) Notice: Subject to any disclaimer, the term of this patent is extended or adjusted under 35 U.S.C. 154(b) by 313 days.

(21) Appl. No.: 10/071,911

(22) Filed: Feb. 7, 2002

(65) Prior Publication Data

US 2003/0145416 A1 Aug. 7, 2003

(51) Int. Cl.[7] ..... A47L 9/22
(52) U.S. Cl. ..... 15/327.2; 15/327.6; 15/330
(58) Field of Search ..... 15/327.1, 327.6, 15/328, 329, 330, 323.1, 327.2

(56) References Cited

U.S. PATENT DOCUMENTS 3,081,478 A 3/1963 Smithson
4,827,560 A 5/1989 Eggert
5,093,956 A 3/1992 Saunders et al.
5,404,614 A 4/1995 Stephens
5,606,769 A 3/1997 Tomasiak et al.
5,611,107 A 3/1997 Tomasiak et al.
6,003,200 A 12/1999 Potts et al.
6,055,700 A 5/2000 Holsten et al.
6,101,669 A 8/2000 Martin et al.

*Primary Examiner*—Theresa T. Snider
(74) *Attorney, Agent, or Firm*—Wildman, Harrold, Allen & Dixon LLP; Thomas J. Ring

(57) ABSTRACT

A locking system for a vacuum cleaner having a top portion and a bottom portion where the bottom portion has an opening. The locking system includes a shoulder extending from an inside surface of the bottom portion, a boss protruding from an outside surface of the bottom portion, a first locking latch secured to the top portion, the first locking latch adapted to extend in to the bottom portion of the vacuum and abut a bottom section of the shoulder and a second locking latch secured to the top portion, the second locking latch adapted to engage the boss. A method for locking the top portion of the vacuum to the bottom portion is also disclosed.

23 Claims, 1 Drawing Sheet

VACUUM CLEANER LOCKING SYSTEM

FIELD OF THE INVENTION

The invention involves a locking system in general, and in particular, a locking system utilized in securing the head and container of a vacuum cleaner to each other.

BACKGROUND OF THE INVENTION

For a vacuum cleaner to operate properly, it is necessary that an operator be able to have access to the inside of the vacuum cleaner in order to empty a collection container or replace a collection bag or filter. This is especially true when operating a wet/dry vacuum as the filter bag used to collect dust and particles when operating in the dry mode must be removed before using the vacuum to pick-up water or other liquids.

The ability to open the vacuum cleaner housing creates the need to ensure that when closed, a proper seal is formed around the housing. A proper seal is required in order to maintain a desired vacuum pressure within the housing while the vacuum is in operation.

One way of forming a seal is through the use of a locking mechanism that tightly secures any access door to the housing or any two portions of a cleaner housing together. Known locking mechanisms have involved a plurality of latches and connectors that have been mounted on the outside of the housing. These connectors are usually screwed or bolted into the housing. A problem associated with these connectors is that they require extra tools and manpower to assemble. Other locking mechanisms have utilized multiple connectors, all of which are released from the outside of the housing. A problem associated with these locking mechanisms is that one of the latches may become broken or worn, thereby reducing the effectiveness of the seal formed around the opening in the housing. This in turn reduces the efficiency of the vacuum cleaner.

Given the shortcomings of known vacuum cleaner locking mechanisms, a locking system that can be simply secured and released from a single location on a vacuum cleaner housing would be an important improvement in the art.

SUMMARY OF THE INVENTION

The invention involves a locking system for a vacuum cleaner that includes a top portion and a bottom portion where the bottom portion has an opening. The locking system is comprised of a shoulder extending from an inside surface of the bottom portion, a boss protruding from an outside surface of the bottom portion, a first locking latch secured to the top portion, where the first locking latch is adapted to extend into the bottom portion of the vacuum and abut a bottom portion of the shoulder and a second locking latch secured to the top portion, with the second locking latch adapted to engage the boss.

The invention also involves a method for locking the top portion of a vacuum cleaner to the bottom portion of the vacuum cleaner, the method is comprised of the steps of: (1) aligning the top portion of the vacuum cleaner with the bottom portion of the vacuum cleaner so that a first locking latch secured to the top portion engages a bottom section of a shoulder circumscribing an opening in the bottom portion of the vacuum cleaner; and (2) latching a second locking latch to a boss extending from an outside surface on the bottom portion of the vacuum cleaner.

BRIEF DESCRIPTIONS OF THE DRAWINGS

DETAILED DESCRIPTION OF THE INVENTION

Figure 1:
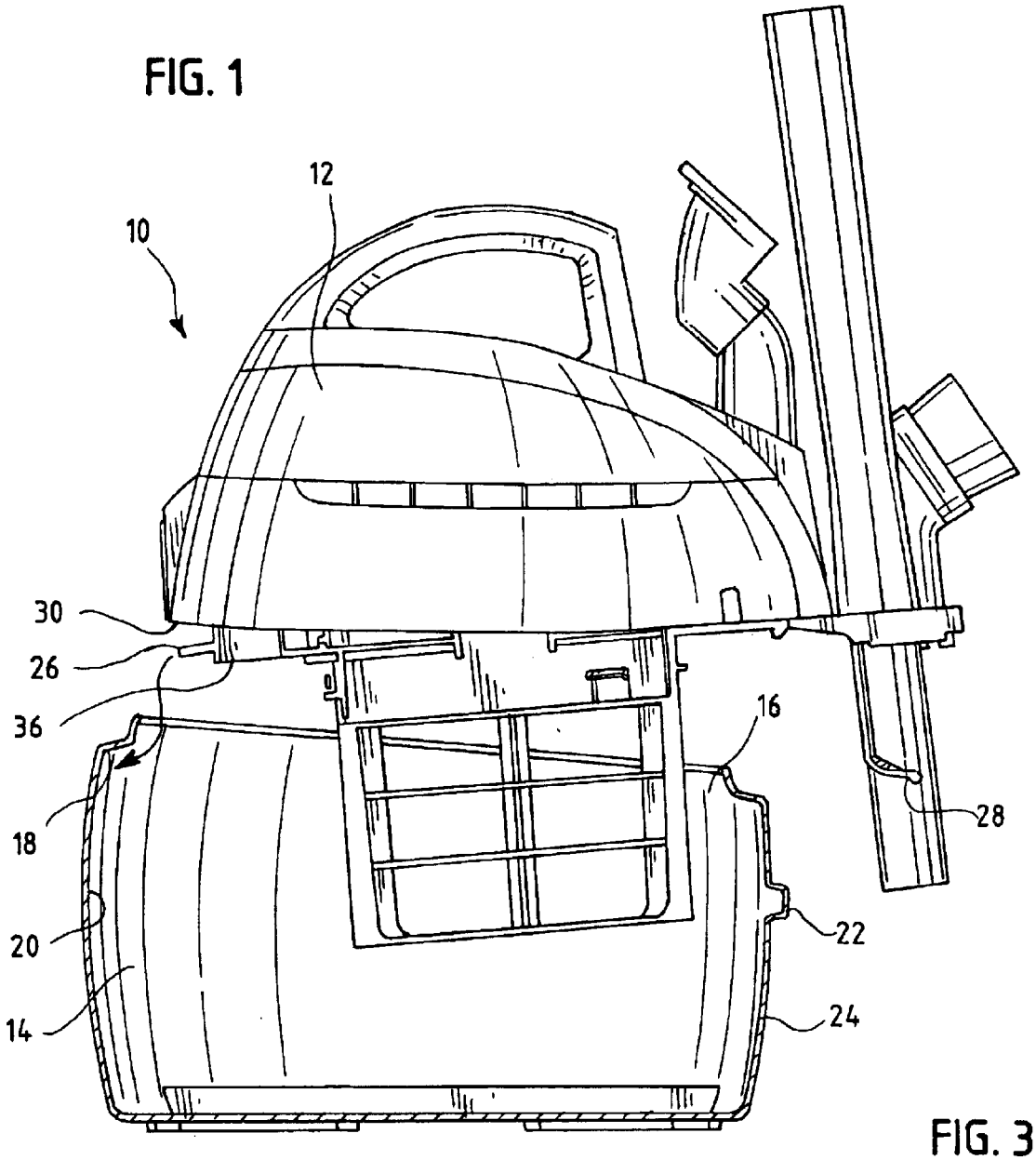
FIG. 1 is a side elevation view of a vacuum cleaner showing the top portion separated from the bottom portion.
Figure 3:
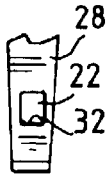
FIG. 3 is a plan view showing the second locking latch engaged to the boss.
Figure 2:
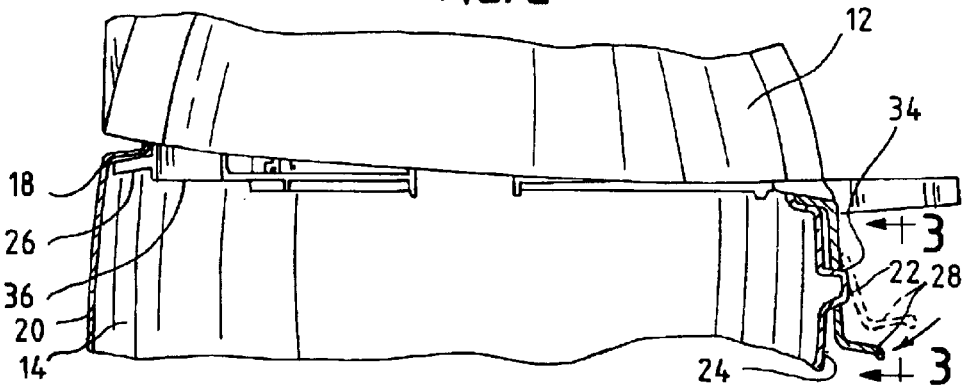
FIG. 2 is a partial view of the vacuum cleaner with the top portion engaged to the bottom portion.

As shown in FIGS. 1–3, the invention involves a locking system for a vacuum cleaner 10 that includes a top portion 12 that may, for example, house the vacuum's power unit (not shown) and a bottom portion 14 that may serve as the collection canister. In this particular invention, the bottom portion 14 has an opening 16 and the locking system is comprised of a shoulder 18 extending from an inside surface 20 of the bottom portion 14, a boss 22 protruding from an outside surface 24 of the bottom portion 14, a first locking latch 26 secured to the top portion 12, the first locking latch 26 adapted to extend into the bottom portion 14 of the vacuum cleaner 10 and abut a bottom portion of the shoulder 18 and a second locking latch 28 secured to the top portion 12, the second locking latch 28 adapted to engage the boss 22.

In one embodiment of the invention, the first and second locking latches 26, 28 are integrally molded with the top portion 12. The shoulder 18 may also be integrally molded into the bottom portion 14 of the vacuum cleaner 10, and may extend from a the inside surface 20 of the bottom portion 14 toward the boss 22. In the present embodiment, the first locking latch 26 is more rigid in construction than the second locking latch 28 which is accomplished by the second locking latch 28 having a greater length than the first locking latch 26 as seen in FIGS. 1 and 2. This can also be accomplished by having different shapes and/or thicknesses of latches 26 and 28. It is contemplated that in other embodiments, the second locking latch 28 may be made of a different and more flexible material than latch 26 so that it is less rigid than the first locking latch 26.

As shown in FIG. 1, the first locking latch 26 may be substantially planar in shape. The latch 26 may be in various forms, including a tab. Furthermore, the first locking latch 26 may be spaced apart from the bottom edge 30 of the top portion 12.

FIG. 3 shows another embodiment of the invention where the second locking latch 28 includes a latch opening 32 and the latch opening 32 circumscribes the boss 22 when the top portion 12 is locked in place. In such embodiment, the second locking latch 28 is positioned so as to engage an outer surface 34 of the boss 22 thereby biasing the second locking latch 28 in a direction away from the outside surface 24 of the bottom portion 14. Once the latch opening 32 in the second locking latch 28 circumscribes the boss 22, the second locking latch 28 moves toward the outside surface 24 of the bottom portion 14 with the boss 22 aligned in the latch opening 32.

In still another embodiment, the shoulder 18 circumscribes the opening 16 in the bottom portion 14.

In another embodiment of the invention, as shown in FIGS. 1 and 2, a mounting platform 36 is secured to the top portion 12 and both the first and second locking latches 26, 28 extend from the mounting platform 36. When in operation, the first locking latch 26 extends from the mounting platform 36 and abuts a bottom section of the shoulder 18 and the second locking latch 28 extends from the mounting platform 36 and engages the boss 22. In such an embodiment, the first and second locking latches 26, 28 may be integrally molded to the mounting platform 36. The first locking latch 26 and the second locking latch 28 may also be positioned on opposite sides of the mounting platform 36. In still another embodiment of the invention, the first and second locking latches 26, 28 are each positioned below a bottom edge 30 of the top portion 12.

In all embodiments of the invention, the top portion 12, bottom portion 14 and the mounting platform 36 are such that they may be manufactured of molded plastic.

The invention also involves a method for locking the top portion 12 of a vacuum cleaner 10 to the bottom portion 14, the method is comprised of the steps of: (1) aligning the top portion 12 of the vacuum cleaner 10 with the bottom portion 14 of the vacuum cleaner 10 so that a first locking latch 26 secured to the top portion 12 engages a bottom section of a shoulder 18 circumscribing at least a portion of an opening 16 in the bottom portion 14 of the vacuum cleaner 10; and (2) latching a second locking latch 28 to a boss 22 extending from an outside surface 24 on the bottom portion 14 of the vacuum cleaner 10.

The method may also include the step of positioning the top portion 12 of the vacuum cleaner 10 over the entire bottom portion 14 so as to completely cover the opening 16 in the bottom portion 14 of the vacuum cleaner 10. Furthermore, the method may also be comprised of the step of positioning the second locking latch 28 so as to contact the boss 22 and bias the second locking latch 28 in a direction away from a the outside surface 24 of the bottom portion 14. In this embodiment, the boss 22 is also aligned with a latch opening 32 defined in the second locking latch 28. The boss 22 is then positioned so as to protrude through the latch opening 32, thereby permitting the second locking latch 28 to move toward the outside surface 24 of the bottom portion 14.

While the principles of the invention have been shown and described in connection with but a few embodiments, it is understood clearly that such embodiments are by way of example and are not limiting.

What is claimed is:

1. A locking system for a vacuum cleaner having a top portion and a bottom portion where the bottom portion includes an opening and the locking system is comprised of:

a shoulder extending from an inside surface of the bottom portion;

a boss protruding from an outside surface of the bottom portion;

a first locking latch secured to the top portion, the first locking latch adapted to extend into the bottom portion and abut a bottom portion of the shoulder; and a second locking latch secured to the top portion, the second locking latch adapted to engage the boss.

2. The locking system of claim 1 wherein the first and second locking latches are integrally molded with the top portion.

3. The locking system of claim 1 wherein the shoulder is integrally molded into the bottom portion of the vacuum cleaner.

4. The locking system of claim 1 wherein the shoulder extends from the inside surface of the bottom portion toward the boss.

5. The locking system of claim 1 wherein the first locking latch is of more rigid construction than the construction of the second locking latch.

6. The locking system of claim 1 wherein the first locking latch is substantially planar in shape.

7. The locking system of claim 6 in which the first locking latch is a tab.

8. The locking system of claim 1 wherein the first locking latch is spaced apart from a bottom edge of the top portion.

9. The locking system of claim 1 wherein the second locking latch has a greater length than the first locking latch.

10. The locking system of claim 1 wherein the second locking latch is positioned to engage an outer surface of the boss biasing the second locking latch in a direction away from the outside surface of the bottom portion.

11. The locking system of claim 10 wherein the second locking latch includes a latch opening adapted to circumscribe the boss, thereby allowing the second locking latch to move toward the outside surface of the bottom portion with the boss aligned with the latch opening.

12. The locking system of claim 1 wherein the shoulder circumscribes at least a portion of the opening.

13. The locking system of claim 12 wherein the shoulder circumscribes the entire opening.

14. The locking system of claim 1 wherein:

a mounting platform is secured to the top portion; and the first and second locking latches extend from the mounting platform.

15. The locking system of claim 14 wherein the first and second locking latches are integrally molded to the mounting platform.

16. The locking system of claim 14 wherein the first locking latch and the second locking latch are positioned on opposite sides of the mounting platform.

17. The locking system of claim 14 wherein the first and second locking latches are each positioned below a bottom edge of the top portion.

18. The locking system of claim 14 wherein the top portion, the bottom portion and the mounting platform are constructed of molded plastic.

19. A method of locking a top portion of a vacuum cleaner to a bottom portion of the vacuum cleaner, the method comprised of the steps of:

aligning the top portion of the vacuum cleaner with the bottom portion of the vacuum cleaner so that a first locking latch secured to the top portion engages a bottom section of a shoulder circumscribing at least a portion of an opening in the bottom portion of the vacuum cleaner; and latching a second locking latch secured to the top portion to a boss extending from an outside surface on the bottom portion of the vacuum cleaner.

20. The method of claim 19 further comprising positioning the top portion of the vacuum cleaner over the entire bottom portion so as to completely cover the opening in the bottom portion of the vacuum cleaner.

21. The method of claim 19 further comprising positioning the second locking latch to contact the boss and bias the second locking latch in a direction away from the outside surface of the bottom portion.

22. The method of claim 21 further comprising aligning the boss with a latch opening defined in the second locking latch.

23. The method of claim 22 further comprising positioning the boss to protrude through the latch opening and permitting the second locking latch to move toward the outside surface of the bottom portion.

* * * * *

UNITED STATES PATENT AND TRADEMARK OFFICE

CERTIFICATE OF CORRECTION

PATENT NO. : 6,807,706 B2
DATED : October 26, 2004
INVENTOR(S) : Jesus Fernandez-Grandizo Martinez It is certified that error appears in the above-identified patent and that said Letters Patent is hereby corrected as shown below:

Column 2,
Line 32, after "from" delete "a".

Column 3,
Line 31, after "from" delete "a".

Signed and Sealed this

Third Day of May, 2005

JON W. DUDAS
*Director of the United States Patent and Trademark Office*